US005378116A

United States Patent [19]

Bennitt et al.

[11] Patent Number: 5,378,116

[45] Date of Patent: Jan. 3, 1995

[54] OVER-PRESSURE RELIEF MEANS

[75] Inventors: Robert A. Bennitt, Painted Post; Derek Woollatt, Campbell, both of N.Y.

[73] Assignee: Dresser-Rand Company, Corning, N.Y.

[21] Appl. No.: 234,688

[22] Filed: Apr. 29, 1994

[51] Int. Cl.[6] ..... F04B 49/00

[52] U.S. Cl. ..... 417/296; 417/296; 417/311

[58] Field of Search ..... 417/296, 298, 307, 311, 417/440

[56] References Cited

U.S. PATENT DOCUMENTS

| | | | |
|---|---|---|---|
| 1,931,833 | 10/1933 | Sparacino | 417/298 |
| 1,943,102 | 1/1934 | Woodruff | 417/296 |
| 1,994,146 | 3/1935 | Ochel | 417/298 |
| 2,626,099 | 1/1953 | Ashley | 417/298 |
| 3,814,546 | 6/1974 | Ostwald | 417/298 |
| 5,011,383 | 4/1991 | Bennitt . | |
| 5,015,158 | 5/1991 | Bennitt . | |
| 5,141,413 | 8/1992 | Bennitt . | |

FOREIGN PATENT DOCUMENTS

| | | | |
|---|---|---|---|
| 0016568 | 7/1927 | Netherlands | 417/296 |

*Primary Examiner*—Richard A. Bertsch
*Assistant Examiner*—M. Kocharov
*Attorney, Agent, or Firm*—Bernard J. Murphy

[57] ABSTRACT

Inlet valves, in a fluid-pressuring cylinder, are biasingly held in given operative positions where they occlude passageways, formed in the cylinder, which open at opposite ends onto the cylinder interior and the cylinder exterior. When an incompressible slug of liquid enters the cylinder, the relevant valve retracts against the bias thereof to expose the passageway, whereby the risk of over-pressuring is avoided, and the excess pressure is simply vented through the passageway(s), directly to the exterior of the cylinder.

14 Claims, 1 Drawing Sheet

OVER-PRESSURE RELIEF MEANS

This invention pertains to reciprocating-piston, fluid-pressuring machines, such as gas compressors, pumps, and the like, and in particular to means for relieving over-pressure conditions within such machines.

The invention comprises a safety arrangement for dealing with that which is called an upset condition, i.e., when the cylinder of the machine receives a liquid slug. Prior art machines which cannot relieve the excess pressure which occurs, when the machine encounters such a slug, can suffer fracture of the piston or valves, or the cylinder itself can blow apart.

It is an object of this invention, then, to set forth, in a reciprocating-piston, fluid-pressuring machine, having a cylinder, over-pressure relief means, comprising a passageway, in said cylinder, which opens at one end thereof onto an interior of said cylinder, and at the end opposite which opens onto an exterior of said cylinder; and means movable within said cylinder, in response to over pressure in said cylinder, from a first position occluding said one end from said cylinder interior to a second position exposing said one end to said cylinder interior.

It is also an object of this invention to disclose, in a gas compressor having (a) a cylinder, and (b) a fluid inlet valve set in said cylinder in a given, operative position therein, over-pressure relief means, comprising first means, interposed between said cylinder and said valve, responsive to an excessive pressure bearing upon said valve for accommodating a displacement of said valve from said given position; and second means, in said cylinder, operative in response to a displacement of said valve for venting fluid from said cylinder.

Figure 1:
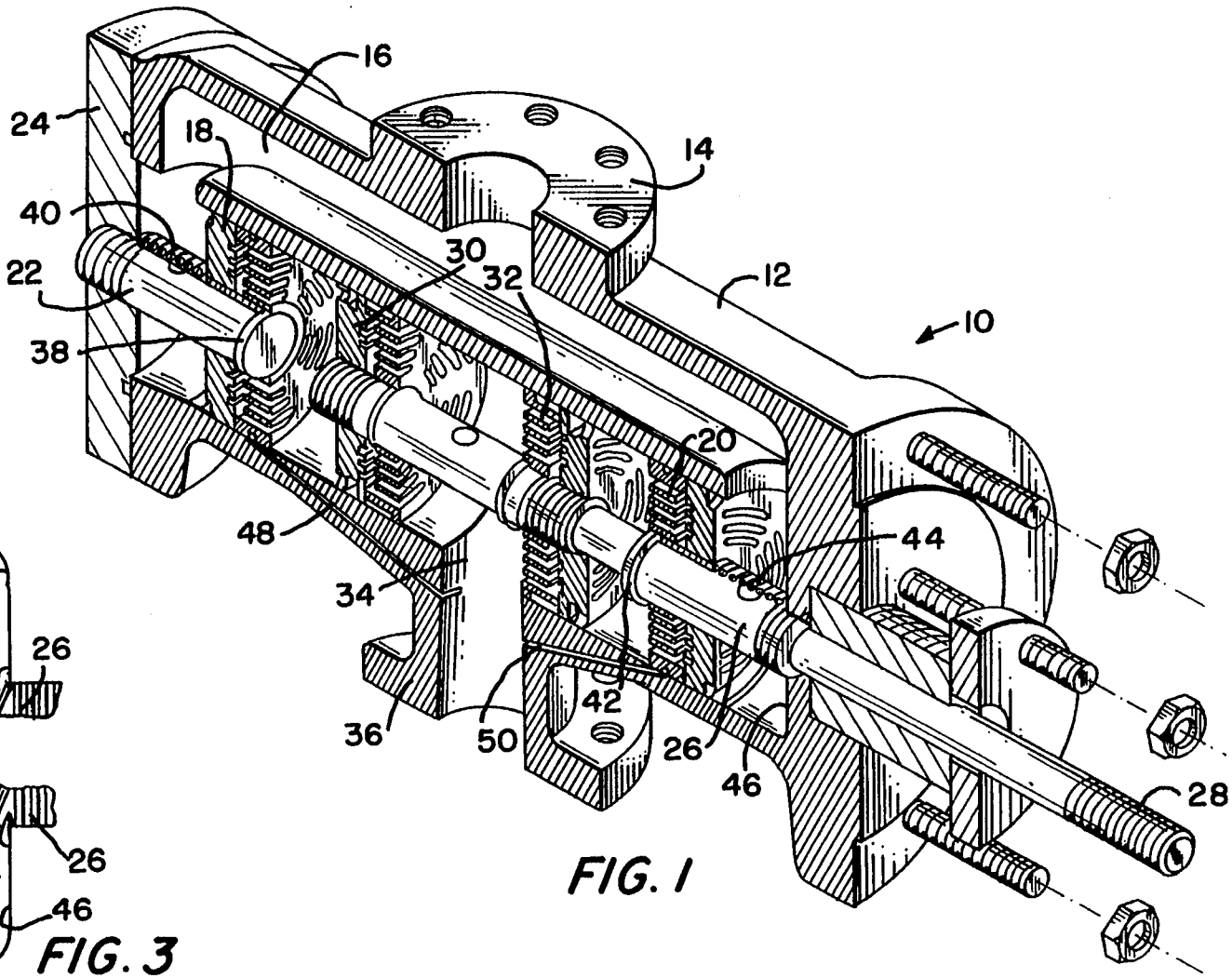
Figure 2:
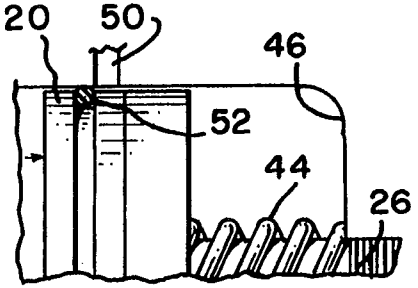
Figure 3:
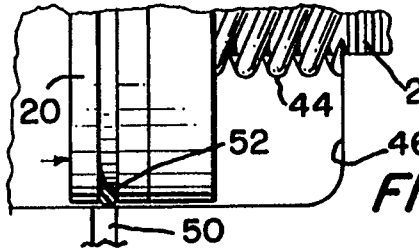

Further objects of this invention, as well as the novel features thereof, will become apparent by reference to the following description, taken in conjunction with the accompanying figures, in which:

FIG. 1 is an axial cross-sectional view, in perspective, of a gas compressor which has an embodiment of the invention incorporated therein;

FIG. 2 is a simple line depiction of the piston, cylinder end, spring, and over-pressure relief passageway port, showing the latter occluded by the piston; and FIG. 3 is a line depiction, like that of FIG. 2, showing the over-pressure relief passageway port exposed to the cylinder interior. In FIGS. 2 and 3, only halves of the piston, spring, and cylinder end are shown, and in FIG. 2, the port is shown rotated one hundred and eighty degrees from its actual disposition only for simplicity of illustration.

The gas compressor 10 shown in FIG. 1 is of a type disclosed in prior U.S. Pat. Nos. 5,011,383; 5,015,158 and 5,141,413, as well as co-pending patent application Ser. No. 08/218,404, filed on Mar. 28, 1994, by Robert A. Bennitt, for Valve Unloading Means, and a Valve Unloading Actuator Therefor. Said patents and application are incorporated herein by reference for a background understanding of the nature of the compressor 10. The aforesaid patents and application disclose compressors having straight cylinders with inlet valves mounted therein, means for admitting gas thereinto, an outlet means for discharging compressed gas therefrom, and reciprocable, discharge valves, piston-ringed, which serve to control the discharge of the compressed gas, and as pistons for compressing the gas, the discharge valves also being confined within the cylinder.

Compressor 10 comprises a straight cylinder 12, the cylinder having a gas inlet flange 14 which opens onto an inlet plenum 16. The gas admitted into the cylinder 12 passes from the plenum 16 to opposite ends thereof where inlet valve assemblies 18 and 20 are arranged. Valve assemblies 18 and 20 are centrally bored, and valve assembly 18 is mounted on a rod 22 which is threadedly fixed in an end header 24. Valve assembly 20 is mounted on a hollow rod 26 which, also, is threadedly fixed, in an end of cylinder 12. A reciprocable rod 28, which translates through rod 26, has a threaded end for coupling thereof to a prime mover (not shown). Mounted on the cylinder confined portion of rod 28 are discharge valves 30 and 32. As noted above, the latter serve as fluid control valves and as gas-compressing pistons. Intermediate the ends of the cylinder 12 is a gas discharge port 34 which terminates in a flange 36.

Rod 22 has an annular shoulder 38 formed thereon, and valve assembly 18 is set there-against, and is slidably engaged with the rod 22. Interposed between the end header 24 and the valve 18 is a compression spring 40. Similarly, rod 26 has an annular shoulder 42 formed thereon, and valve assembly 20 is set against this shoulder 42, being slidably engaged with the rod 26. Another compression spring 44 is interposed between valve assembly 20 and an end wall 46 of the cylinder 12. A passageway 48 is formed in the cylinder 12, the passageway opening onto the cylinder interior whereat the valve assembly 18 is disposed, and opening at the end opposite onto the port 34. A corresponding passageway 50 is formed in the cylinder 12, this passageway 50 opening onto the interior of the cylinder 12 whereat the valve assembly 20 is disposed, and opening at the end opposite onto the port 34 also.

FIG. 2 depicts a portion of valve assembly 20, spring 44, and the cylinder-opening end of the passageway 50. The valve assembly 20 has a seal 52 thereabout for closing off the corresponding end of the cylinder 12, whereat the spring 44 is confined, from the intermediate portion of the cylinder in which the discharge valves 30 and 32 are operative. Valve assembly 20 is shown, in FIG. 2, in its normally-operative disposition and, as can be seen, it occludes the interior of the cylinder 12 from the passageway 50, i.e., the valve assembly positioning seals off the cylinder-opening end of the passageway 50 from the intermediate, compression volume of the cylinder 12.

When an incompressible slug of liquid enters the cylinder, and the pressure therein resultantly escalates critically, the valve 20 assembly yields, compressing the spring 44, and retracting toward the end wall 46 as it moves along the rod 26. Consequently, the seal 52.moves sufficiently to expose the cylinder-opening end of the passageway 50 to the compression volume of the cylinder 12, and vents an over-pressuring fluid therethrough directly to the exterior of the compressor 10. FIG. 3 depicts the aforesaid pressure-relieving action, where the passageway end is free to communicate with the cylinder interior inboard of the valve assembly 20.

It will be appreciated that a same pressure-relieving function proceeds from the like structure and arrangement of passageway 48, valve assembly 18 and spring 40.

While we have described our invention in connection with a specific embodiment thereof, it is to be clearly understood that this is done only by way of example, and not as a limitation to the scope of the invention as set forth in the objects thereof and in the appended claims.

We claim:

1. In a reciprocating-piston, fluid-pressuring machine, having a cylinder, over-pressure relief means, comprising:

a passageway, in said cylinder, which opens at one end thereof onto an interior of said cylinder, and at the end opposite which opens onto an exterior of said cylinder; and means movable within said cylinder, in response to over pressure in said cylinder, from a first position occluding said one end from said cylinder interior to a second position exposing said one end to said cylinder interior; wherein said movable means comprises a fluid inlet valve assembly.

2. Over-pressure relief means, according to claim 1, further including:

means wholly confined within said cylinder, and interposed between said fluid inlet valve assembly and a surface of said cylinder for biasingly restraining said fluid inlet valve assembly in said first position.

3. Over-pressure relief means, according to claim 2, wherein:

said cylinder has an end wall; and further including means wholly confined within said cylinder, and interposed between said end wall and said valve assembly for biasingly restraining said valve assembly in said first position.

4. In a gas compressor having (a) a cylinder, and (b) a fluid inlet valve set in said cylinder in a given, operative position therein, over-pressure relief means, comprising:

first means, wholly confined within said cylinder, and interposed between a surface of said cylinder and said valve for allowing a displacement of said valve from said given position; and second means, in said cylinder, operative in response to a displacement of said valve for venting fluid from said cylinder.

5. Over-pressure relief means, according to claim 5, wherein:

said first means comprises means for biasingly restraining said valve against displacement thereof from said given position.

6. Over-pressure relief means, according to claim 5, wherein:

said first means comprises a compression spring.

7. Over-pressure relief means, according to claim 5, wherein:

said cylinder has an end wall; and said first means is interposed between said end wall and said valve.

8. Over-pressure relief means, according to claim 4, wherein:

said second means comprises a passageway opening at one end onto an interior of said cylinder, and opening at the end opposite onto an exterior of said cylinder.

9. In a gas compressor having (a) a cylinder, and (b) a fluid inlet valve set in said cylinder in a given, operative position therein, over-pressure relief means, comprising:

first means, interposed between said cylinder and said valve, responsive to an excessive pressure bearing upon said valve for allowing a displacement of said valve from said given position; and second means, in said cylinder, operative in response to a displacement of said valve for venting fluid from said cylinder; and further including a rod confined within said cylinder; and wherein said valve is centrally bored; and said rod penetrates said bore, supporting said valve thereon.

10. Over-pressure relief means, according to claim 9, wherein:

said rod has an annular shoulder formed thereon;

said valve is set against said shoulder;

said cylinder has an end wall; and said first means is interposed between said end w-all and said valve.

11. Over-pressure relief means, according to claim 10, wherein:

said first means comprises a compression spring.

12. Over-pressure relief means, according to claim 11, wherein:

said spring is set about said rod.

13. Over-pressure relief means, according to claim 9, wherein:

said rod is fixed in said cylinder.

14. Over-pressure relief means, according to claim 9, wherein:

said rod is hollow and fixed in said cylinder.

* * * * *

UNITED STATES PATENT AND TRADEMARK OFFICE

CERTIFICATE OF CORRECTION

PATENT NO. 5,378,116

DATED Jan. 3, 1995

INVENTOR(S) ROBERT A. BENNITT AND DEREK WOOLLATT

It is certified that error appears in the above—identified patent and that said Letters Patent is hereby corrected as shown below:

In column 3, line 45 (Claim 5, line 1), change "claim 5" to - - claim 4 - - .

Signed and Sealed this

Seventh Day of March, 1995

*Attest:*

Bruce Lehman

BRUCE LEHMAN

*Attesting Officer*

*Commissioner of Patents and Trademarks*